US005864987A

United States Patent [19]

Mariel et al.

[11] Patent Number: 5,864,987

[45] Date of Patent: Feb. 2, 1999

[54] WINDOW REGULATOR WITH IMPROVED GLIDER ASSEMBLY

[75] Inventors: James G. Mariel, Mishawaka; Michael D. Kobrehel, Elkhart, both of Ind.; James F. Trevarrow, Goodrich; M. Darren Grumm, Cassopolis, both of Mich.; Robert K. Roth, Elkhart; Andrew C. Smith, South Bend, both of Ind.

[73] Assignee: Excel Industries, Inc., Elkhart, Ind.

[21] Appl. No.: 969,105

[22] Filed: Nov. 13, 1997

Related U.S. Application Data

[63] Continuation of Ser. No. 623,868, Mar. 29, 1996, abandoned.

[51] Int. Cl.[6] ..... E05D 13/00

[52] U.S. Cl. ..... 49/352; 49/349

[58] Field of Search ..... 49/348, 349, 350, 49/351, 352

[56] References Cited

U.S. PATENT DOCUMENTS

| | | | |
|---|---|---|---|
| 3,444,649 | 5/1969 | Rivolier . | |
| 4,090,329 | 5/1978 | Rampel . | |
| 4,235,046 | 11/1980 | Hess et al. . | |
| 4,442,632 | 4/1984 | Greco et al. | 49/352 |
| 4,494,336 | 1/1985 | Ishii et al. | 49/352 |
| 4,502,247 | 3/1985 | Kobayashi et al. . | |
| 4,663,886 | 5/1987 | Makamura et al. | 49/312 X |
| 4,759,653 | 7/1988 | Maekawa et al. | 49/352 X |
| 4,840,080 | 6/1989 | Kobayashi et al. . | |
| 4,970,827 | 11/1990 | Djordjevic . | |
| 4,984,386 | 1/1991 | Marscholl et al. . | |
| 4,991,351 | 2/1991 | Bertolini . | |
| 5,074,077 | 12/1991 | Toyoshima et al. . | |
| 5,359,811 | 11/1994 | Klippert . | |
| 5,398,449 | 3/1995 | Kobrehel et al. | 49/352 |
| 5,469,663 | 11/1995 | TenBrink et al. . | |
| 5,515,651 | 5/1996 | Hofmann et al. | 49/375 |

FOREIGN PATENT DOCUMENTS

| | | |
|---|---|---|
| 0 607 588 A | 7/1994 | European Pat. Off. . |
| 2 552 720 A | 4/1985 | France . |
| 32 14 478A | 10/1983 | Germany . |
| 40 02 274 A | 8/1991 | Germany . |

*Primary Examiner*—Jerry Redman
*Attorney, Agent, or Firm*—Banner & Witcoff Ltd

[57] ABSTRACT

A cable-drum window regulator for controlling the motion of a windowpane, such as a window in a door, has an improved glider assembly. The glider assembly is attached to the windowpane, and comprises a glider slidably secured by snap fit to an elongate guide rail, and a glider plate which snap fits to the glider. The glider assembly travels along the guide rail from a full-up to a full-down position. The glider preferably has a cushioning unitary downstop to absorb the loading of the glider assembly at the full-down position. The glider has at least a pair of rail tabs which snap fit to longitudinally extending receiving flanges of the rail; preferably at least one of the rail tabs has a beveled surface for ease in assembly. The glider has at least one flexible finger with a digit which snaps into a corresponding receiving opening in the glider plate. In those embodiments with more than one flexible finger, one finger is preferably longer than the other. The glider plate may be snap fit directly to the glider or it may be inserted from one side into a slot between glider plate retention tabs and snapped into place. The glider plate has a center portion and a first and second wing; preferably the first and second wing are positioned in an offset plane closer to the windowpane. For ease of assembly, the first wing may be smaller than the center portion and the slot, and the second wing may be larger than the center portion and the slot.

34 Claims, 6 Drawing Sheets

WINDOW REGULATOR WITH IMPROVED GLIDER ASSEMBLY

This application is a continuation of application Ser. No. 08/623,868, filed Mar. 29, 1996, now abandoned.

FIELD OF THE INVENTION

The present invention is directed to an improved cable-drum regulator for controlling the position of a windowpane. More particularly, the invention is directed to a cable-drum regulator having an improved glider assembly connecting the windowpane to the other components of the regulator.

BACKGROUND

Window regulators, which are used for controlling the movement of a windowpane, such as a vertically moveable side window in the door of a motor vehicle, take a variety of forms including cable-drum regulators. Known designs for cable-drum regulators typically include a drive means, such as a hand crank or an electric motor, a mounting bracket securing the fixture to a wall of the door, a drum, a drum housing mounted to the mounting bracket, and at least one cable wrapped at least once around the drum.

Cables typically have a ball or puck of metal at each end to prevent fraying and to provide a ready means for attaching the cable to another structure. In the most common designs a pair of cables are used. One ball of each cable fits into corresponding receiving grooves in the drum. At the other end the other balls fit into receiving seats or grooves in a glider assembly.

The glider assembly is usually fixedly attached to the window by an attachment means and slidingly attached to a track or guide rail which defines the travel of the windowpane between its open and closed positions. The cable is guided along its length between the glider assembly and the motor by guide means, such as sliders or pulleys. The cable is often covered with a sheath or conduit over at least a portion of its travel path to protect it from dirt, oil, the elements and the like. Operation of the motor or hand crank causes the drum to rotate. This unwinds cable in one direction and winds cable in the other direction. As the cable moves, it pulls the glider assembly and in turn, the window. In this way the cables transfer the necessary forces from the drive means to the glider assembly to raise and lower the window.

In known designs the glider assembly typically includes a metal glider wing with a plastic fitting injection molded around the wing. The plastic fitting acts to provide a low friction surface for the glider assembly to slide over the guide rail, and to provide a reduced-noise receiving surface for the cable end balls. In addition, a lower durometer rubber-like bumper is typically attached either to the glider assembly or at the lower end of the guide rail. The bumper serves as a cushioning downstop, halting windowpane travel path with reduced shock loading on the system.

Attaching and securing the cable end balls to the glider assembly in these designs raise several problems. If the cable end balls are attached at a position laterally offset from the longitudinal centerline of the guide rail such that the cables are not aligned with travel path of the windowpane, then the glider assembly will be subjected to torque loading which will increase wear in the glider assembly. In addition, the cable end balls can be attached to the inboard side of the glider assembly, that is, the side facing the rail. However, installation of the cable end balls to the glider assembly in this manner is awkward. Typically the glider assembly must be slid on from one end of the guide rail and the end balls must be attached to the glider assembly prior to installation of the glider assembly over the guide rail. This results in increased assembly time, cost and complexity.

Further, the plastic fitting is typically injection molded onto the wing. The injection molding cavity is formed to receive a specifically sized glider wing. While this is acceptable for any one window, a window of a different size may require a larger glider wing, for example, for optimum location of the attachment means. Therefore known designs require use of a different glider assembly for each size window.

It is an object of the present invention to provide a cable-drum regulator of improved design which, especially in preferred embodiments, is easy to manufacture and assemble, and reduces complexity and cost. It is a further object of the present invention to provide a cable-drum regulator with a glider assembly of improved design that allows for windowpanes of varying sizes. Additional objects and features of the invention will become apparent from the following disclosure taken together with the detailed discussion of certain preferred embodiments.

SUMMARY

In accordance with a first aspect, a cable-drum regulator is provided with a drive means, a mounting bracket supporting the drive means, a glider assembly fixedly attached by an attachment means to a windowpane and slidingly attached to a guide rail or track, and a cable assembly to transfer the force of the drive means to open and close the windowpane. The cable assembly includes a cable and optionally a conduit covering a portion of the cable. The cable assembly has a tensioning device such as a spring to take up slack in the cable.

The glider assembly includes a glider and a glider wing or plate. In a highly advantageous feature the glider is provided with guide rail retention hooks or tabs which snap fit over a pair of glider receiving projections or flanges extending longitudinally along the guide rail. The glider assembly need not be slid on from the end of the guide rail, greatly enhancing the ease in assembly of the regulator. Optionally a cable end ball can be attached to the glider prior to snap fitting the glider onto the rail. In addition, the glider plate may be attached to the glider before or after the glider is attached to the guide rail.

Attachment of the glider plate to the glider preferably sandwiches the cables between the glider and the glider plate, securing the cables to the glider assembly while allowing installation of the cables from the readily accessible, outboard side of the glider.

The glider preferably has a cable run channel, cable end ball entry ports and cable end ball seats or retaining locations. The cable end ball entry ports are preferably positioned on the outboard side of the glider, that is, the side of the glider facing the glider wing.

In accordance with a highly advantageous feature, the glider and glider plate may be snap fit together to form a glider assembly. In one embodiment, the glider has at least one flexible finger with an insertion digit which during assembly snaps into a corresponding opening in the glider plate, preferably into a through-hole which allows access for pressing the insertion digit out of the plate opening for disassembly. The flexible fingers preferably are unitary with the main body of the glider, being formed therewith in a single molding operation. In those embodiments with more than one such finger, one finger is preferably longer than the other to facilitate assembly.

In accordance with certain preferred embodiments the glider plate has a center portion as well as first and second wings extending in opposite directions laterally from the center portion. The wings each have attachment means for securing the glider plate to the windowpane, such as holes for receiving a bolt. In certain preferred embodiments the wings extend in a plane which is parallel and offset from the plane of the center portion, preferably being outboard from the center portion. That is the wings are positioned closer to the windowpane than the center portion. The glider plate can advantageously be formed of plastic or of sheet metal, for example sheet steel, with well known metal stamping and hole punching operations, etc. In accordance with certain preferred embodiments the glider wing is insertable laterally into the glider from one side between upper and lower glider plate retention tabs which are preferably unitary with the main body of the glider. The wings of the glider plate can advantageously be of different sizes such that insertion is possible only in correct orientation. For ease in installation, one wing preferably has a height less than the side opening of the glider, (that is, the slot size between the glider retention tabs) and the center portion of the glider wing is sized to fit snugly into the glider slot. The second wing may have a height greater than the center portion, preventing the insertion of the wing into the glider slot to serve as a positive locating stop.

In certain alternative preferred embodiments the glider plate snap fits directly over the glider. The glider preferably has at least a pair of flexible fingers having extending digits which snap fit over the glider plate, as well as tab-receiving ports preferably positioned adjacent the fingers. The glider plate has openings corresponding to each finger, and tabs that fit into the tab receiving ports to provide additional structural support.

Certain preferred embodiments can provide additional significant advantages with respect to cost and complexity reduction. In a highly advantageous feature shock loads on the regulator system are minimized particularly when the glider assembly reaches the full-down windowpane position by a cushioning downstop unitary with the glider body. Such unitary downstop is preferably made of at least one flexible, open centered, w-shaped member at the lower portion of the glider. Those skilled in the art will recognize from this disclosure the suitability of other unitary open centered downstop configurations which nondestructively absorb the impact energy at the full down position.

An additional highly advantageous feature of this invention is a glider assembly with a complete snap fit arrangement (glider to guide rail, glider plate to glider) allowing for flexibility in the order of assembly of components.

An additional advantage of this invention is that the glider may be attached to glider plates of varying sizes. This would allow a single regulator design to be used on an entire family of windowpanes.

Additional features and advantages of various preferred embodiments will be better understood in view of the detailed description provided below.

BRIEF DESCRIPTION OF THE DRAWINGS

Certain preferred embodiments are discussed below with reference to the appended drawings wherein.

Figure 1:
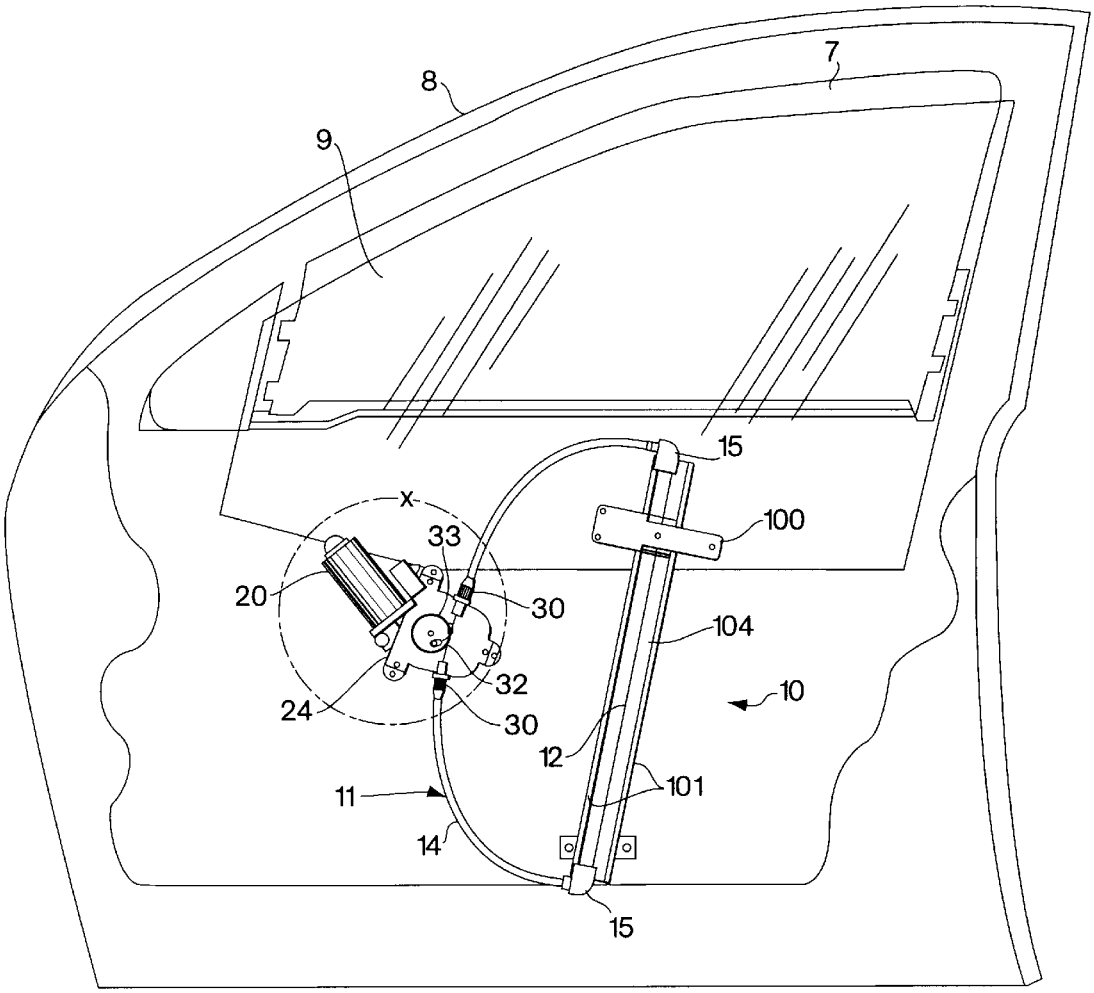
FIG. 1 is a schematic elevation view of a vehicle door defining a window opening in which is mounted a vertically slidable windowpane having a cable-drum regulator assembly in accordance with a preferred embodiment.

It should be understood that the appended drawings are not necessarily to scale, presenting a somewhat simplified representation of certain preferred embodiments illustrative of the basic principles of the invention. The specific design of cable- drum regulator assemblies in accordance with the invention, including, for example, the specific configuration and dimensions of various components, including the glider assembly, will be determined in part by the intended application and use environment of the regulator assembly. Certain features of the cable-drum regulator assembly have been enlarged or distorted relative to others to facilitate visualization and clear understanding. In particular, thin features may be thickened, for example, for clarity of illustration. All references to direction and position, unless otherwise indicated, refer to the orientation of the cable-drum regulator assemblies illustrated in the drawings. In general the guide rail will be considered extending substantially vertically and directions to the right and left of the guide rail in the plane of the paper in FIG. 1 will be referred to as lateral directions. The directions normal to the plane of the paper in FIG. 1 are inboard/outboard. It should be understood that cable-drum regulator assemblies in accordance with the invention can be used in diverse applications.

DETAILED DESCRIPTION OF CERTAIN PREFERRED EMBODIMENTS

The improved cable-drum regulator assemblies illustrated in FIG. 1–8 are suitable for controlling a moveable windowpane to open and close a window opening in a motor vehicle door. The following discussion of certain preferred embodiments focuses on cable-drum regulator assemblies wherein the windowpanes are opened and closed by sliding action vertical with the ground, but the design and operating principles are applicable generally to windows which have alternative open/close directions.

Referring now to the cable-drum regulator assembly depicted in the drawings, in FIG. 1, a motor vehicle door 8 is shown to define a window opening 7 into which the windowpane 9 is pulled from a closed, full-up position to an open-down position by window regulator 10. The cable-drum regulator 10 is shown to have a drive means 20, such as a motor or optionally a manual hand crank, a mounting bracket 24 mounting the drive means 20 to the wall of the door 8, a glider assembly 100 fixedly attached to the windowpane with bolts, brackets or other suitable attachment means, and sliding on a guide rail or track 104, defining the travel of the windowpane between its open and closed positions and fixedly attached to a support structure such as the inner panel of the door, a cable assembly 11, comprising a cable or cables 12, guide means 15, such as pulleys or sliders, for guiding the cable from the drive means 20 to the glider assembly 100, and a conduit 14 covering at least a portion of the cable 12 to protect it from dirt and wear as well as to restrict the free motion of the cable. Typically the conduit is positioned as shown in FIG. 1, between each guide means 15 and the drive means 20.

The drive means 20 imparts rotary motion to a drive drum 32. Preferably, the drum is partially covered by a drum housing 33 to keep dirt and other elements from interfering with the operation of the regulator. Rotary motion of the drive drum 32 is transferred to the glider assembly 100 and to the windowpane 9 by the cable 12. Wrapped around the drive drum is the cable or, more commonly, a pair of cables 12. Each end of each cable has a cable end ball 13, also known as a puck or swage. In designs using a pair of cables, one end of each cable is attached in a slot in the drum 32, and the other ends are attached to the glider assembly 100. Operation of the drive means 20 rotates the drum 32, unwinding one cable 12 in one direction and winding the other cable 12 in the opposite direction. In this way the cables transfer the necessary forces from the drive means to the glider assembly to raise and lower the window.

Figure 2:
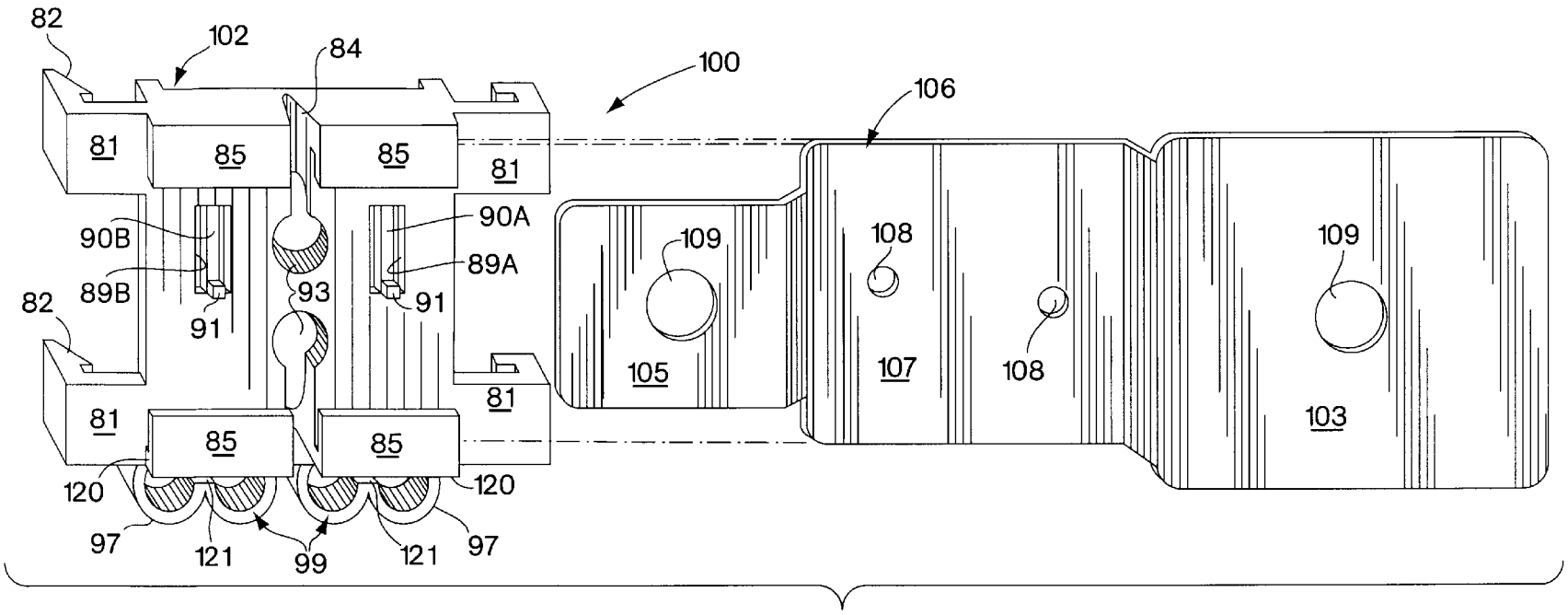
FIG. 2 is an exploded perspective view focusing on a first preferred embodiment of the glider assembly.
Figure 3:
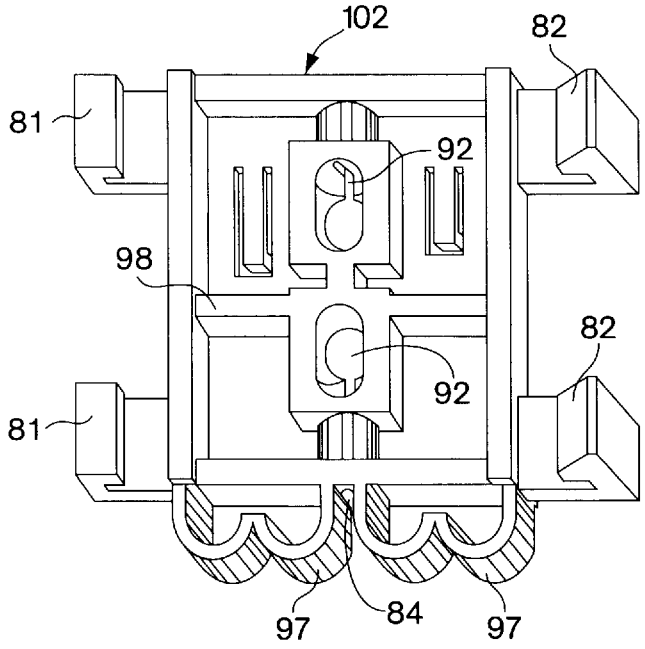
FIG. 3 is a perspective view of the back side of the glider of FIG. 2.

FIGS. 1–3 show a first preferred embodiment of the glider assembly 100. The glider assembly is shown with a glider 102, preferably composed of an engineering polymer, and a glider plate or wing 106. The guide rail 104 has a pair of longitudinally extending right and left glider receiving flanges or projections 101. The glider 102 is slidably secured to the guide rail 104 by right and left rail retention tabs or hooks 81. In a highly advantageous feature of the invention, the glider assembly need not be slide on from an end of the guide rail. Instead, the right and left rail tabs 81 can be snap fit to the corresponding receiving projections 101, greatly speeding assembly of the regulator. It is a highly advantageous feature for the rail tabs 81 of at least one side to have a beveled surface 82 to ease attachment of the glider to the guide rail. FIG. 3 shows a reinforcing structural support rib 98 enhancing the rigidity of the glider.

In FIG. 2 the main body of the glider is seen to have cable run channels 84 leading to an entry port 93. The cable end balls 13 are inserted through the entry port 93 into endball receptacles 92. Preferably the cable is attached from the outboard side of the glider 102, that is, the side of the glider facing the glider plate. Attachment of the glider plate 106 to the glider 102 sandwiches one end of the cable 12 between the glider and the glider plate.

The glider 102 is also seen to have upper and lower glider plate retention hooks 85. These hooks 85 secure the glider plate 106 in four of six directions: inboard, outboard and the up and down directions, with up and down defined as the direction of motion of the glider on the guide rail. Preferably the glider plate retention hooks 85 are unitary with the glider, that is, they are formed of the same injection molded part. In an additional highly advantageous feature of this invention, the glider plate is snap fit to the glider. FIG. 2 shows a glider with first and second finger openings 89A, 89B. Attached to each of the openings at one end is a corresponding first and second flexible finger projection 90A, 90B, each having a glider plate locking projection or insertion digit 91. The flexible fingers preferably are unitary with the main body of the glider, being formed therewith in a single molding operation. In this embodiment the glider plate 106 would be inserted from one side between the upper and lower retention hooks 85. The flexible fingers yield into openings 89A, 89B until the insertion digit 91 of each flexible finger 90A, 90B snap fits into a corresponding through hole 108 in the glider plate. In this manner the glider plate 106 is fixedly secured to the glider 102 to form the glider assembly 100. The through holes or holes 108 allow access for pressing the insertion digits out of the holes for disassembly. It will be readily apparent to those skilled in the art that the snap fit engagement members of the glider and the glider plate may be reversed such that the glider plate has at least on flexible finger provided with an insertion digit and the glider has an opening sized to receive the insertion digit.

In a preferred feature of this invention, first flexible finger 90A is of a length different from second flexible finger 90B. This greatly eases assembly in that as the glider plate 106 is inserted laterally into the glider 102 the insertion digit 91 of the first flexible finger 90A will not snap into the second opening 108 of the glider plate.

The glider plate in FIG. 2 has a center portion 107 and first and second wings 103, 105 extending in opposite directions laterally from the center portion. The wings have attachment means 109 for securing the glazing 9 to the glider plate, such as holes for receiving a bolt or other suitable means. The wings 103,105 may be in a plane parallel and offset to the center portion. In FIG. 2 the wings are connected to the center portion 107 by angled surfaces 110, 111, positioning the wings outboard from the center portion 107, that is, the wings are positioned closer to windowpane 9 to allow for clearance between the windowpane and the glider 102. In addition, the center portion 107 is shown to have a height to fit snugly in the slot size between the retention hooks 85 of the glider, the first wing 103 is shown to have a height less than the center portion, making the plate easier to install, and the second wing 105 is shown to have a height greater than that of the center portion, forming a positive locating stop. It will be readily apparent to those skilled in the art that alternative designs for the glider plate can be used, such as a flat plate having the wings located in the same plane as the center portion, or a plate wherein either of the wings are of the same height as the center portion.

A highly advantageous feature of this invention is that the glider assembly allows for glider plates of varying lengths without having to change the glider. This allows for the use of a single regulator with standardized tooling for a whole family of differently sized windowpanes.

A significant cost advantage over known designs is the incorporation of a cushioning downstop 99 into a unitary glider construction 102. In the embodiments shown in FIGS. 2–4, the unitary cushioning downstop 99 is one or more flexible open centered w-shaped members 97 connected to the glider 102 at each end 120 of the w. As the glider slides on the guide rail 104 from the full-up position to the full-down position, the cushioning downstop contacts the door 8 or cable guide means 15 and absorbs impact energy. The w can flex until the center of the w 121 contacts the main body of the glider. Those skilled in the art will recognize from this disclosure other configurations which nondestructively absorb the impact energy at the full down position, such as a U-shaped cushioning downstop.

Figure 4:
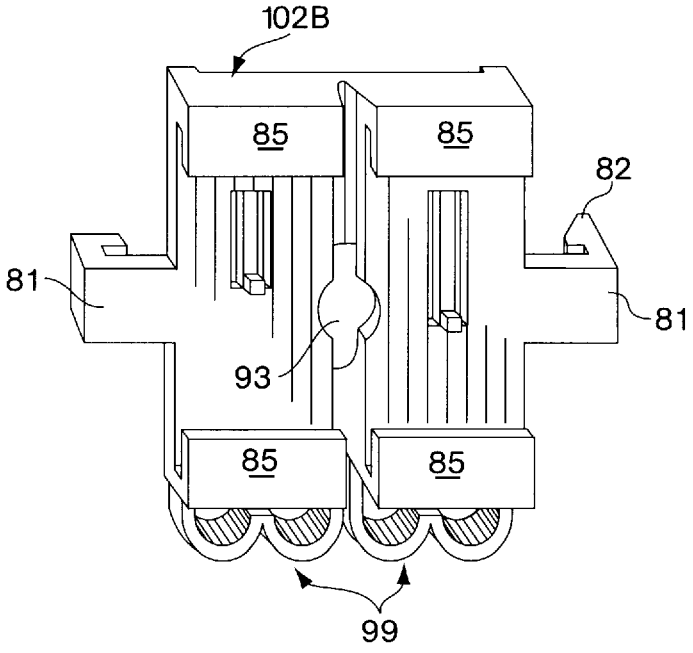
FIG. 4 is a perspective view of an alternative preferred embodiment of the glider.

FIG. 4 shows a compact alternative embodiment of a glider that again snap fits over a rail, snap fits with a glider plate to form a glider assembly and discloses a unitary cushioning downstop. The glider 102B is slidably secured to the longitudinally extending guide rail 101 and has only one rail tab 81 on each side of the glider 102B snap fitting over each corresponding receiving flange 101. Preferably one tab has a beveled surface 82 to enhance assembly of the glider to the guide rail. In addition only one cable end ball entry port 93 leads to both endball receptacles to receive each end of a cable 12. A glider plate 106 similar to the plate disclosed in the first embodiment may be used in this embodiment.

Figure 5:
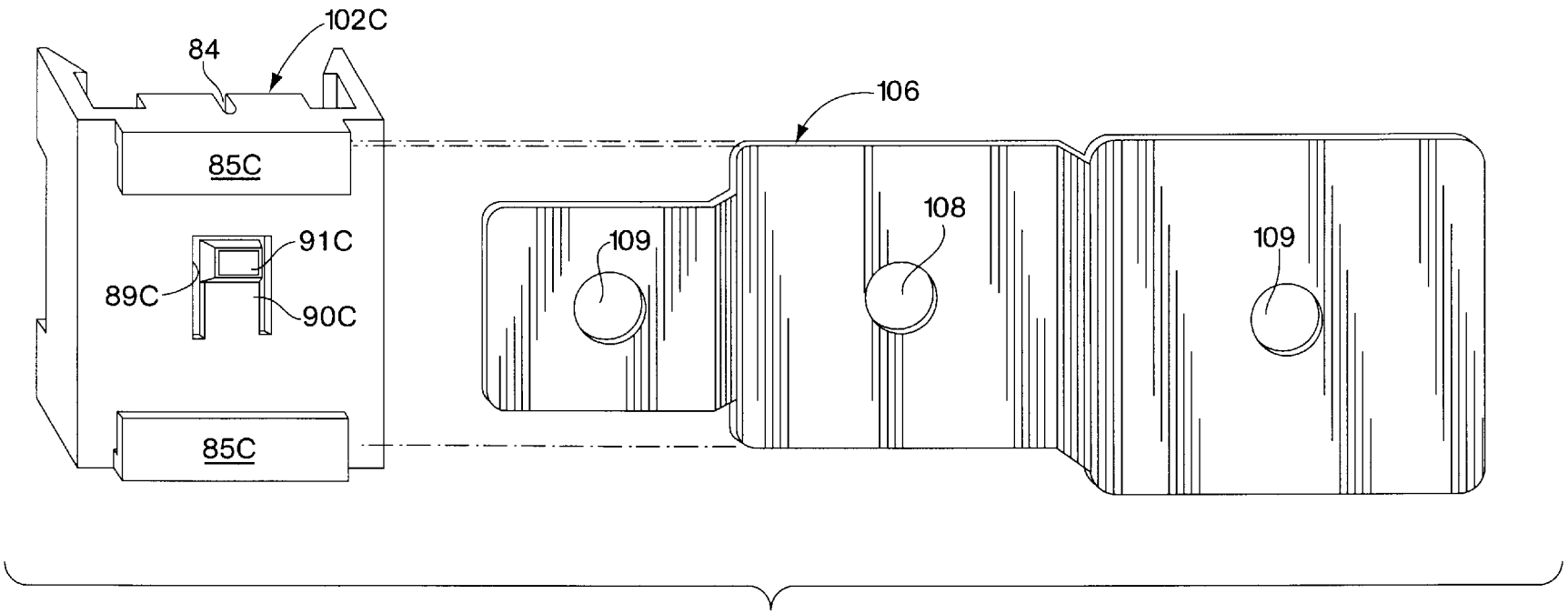
FIG. 5 is an exploded perspective view of a third alternative preferred embodiment of the glider assembly.

FIG. 5 shows a third alternative embodiment of a glider assembly of simplified construction in which the glider snap fits over the guide rail and the glider plate snap fits onto the glider. The glider 102C has only one finger opening 89C, and one flexible finger projection 91C snap fitting into one corresponding opening 108C in glider plate 106C. Further, this embodiment has single upper and lower glider plate retention hooks 85C and the cable run channel, entry port and endball receptacles are located on the inboard side of the glider, that is, the side of the glider facing the rail.

Figure 6:
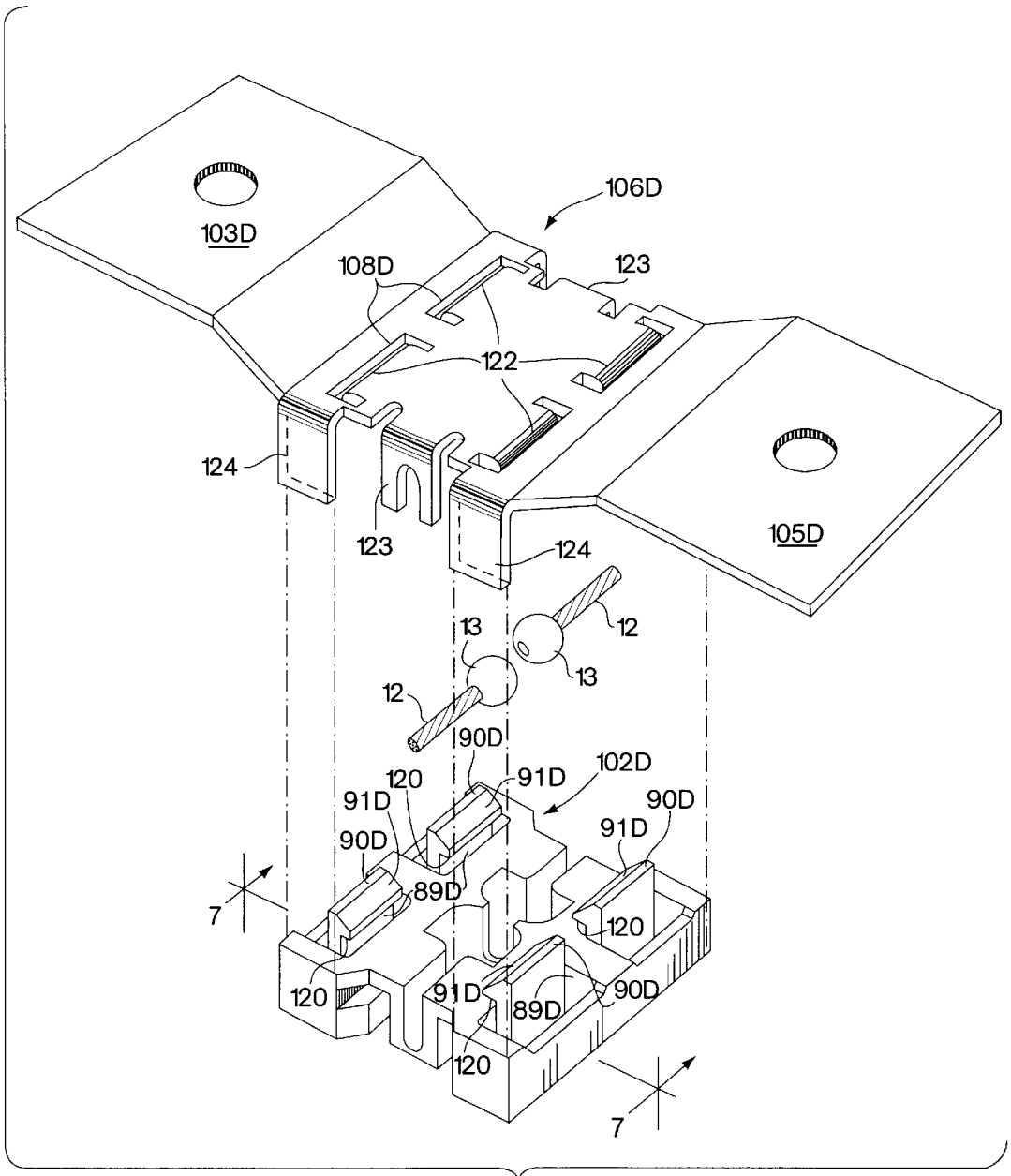
FIG. 6 is an exploded perspective view of a fourth alternative preferred embodiment of the glider assembly.
Figure 7:
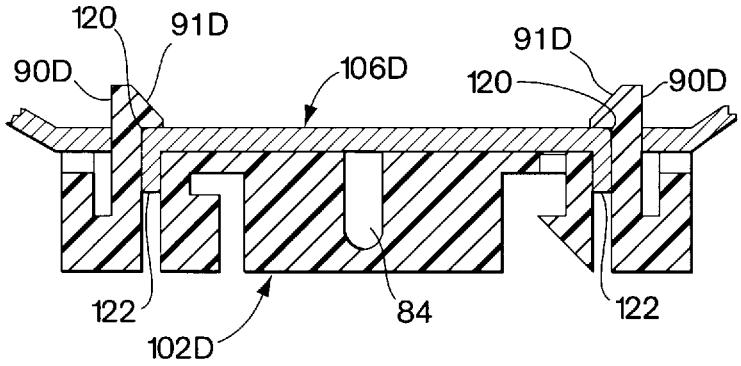
FIG. 7 is an enlarged cross sectional view of the glider and glider plate of FIG. 6, taken along line 7—7 in FIG. 6.

In a fourth alternative embodiment disclosed in FIGS. 6 and 7, the glider 102D snap fits to the guide rail and the glider plate 106D snap fits directly to the glider 102D. The glider is provided with flexible fingers 90D having opposed extending digits 91D surrounded by opening 89D. The opening 89D includes a tab receiving port 120.

The glider plate can be a simple to manufacture metal stamping, and has openings 108D corresponding to each flexible finger 90D and support tabs 122. The extending digits 91D cooperate with the glider plate to secure the glider plate to the glider in all directions, forming the glider assembly 100D. The glider plate tabs 122 fit into receiving ports 120 of the glider.

In FIG. 6, the glider plate is shown to have additional tabs 123 and 124. Tabs 123 serve as locator tabs and provide additional support to the cable run channel 84, and tabs 124 serve as locator tabs and provide additional support to the high stress downstop area. Since the glider plate is snap fit directly onto the glider, the height of the glider wings 103D, 105D is not critical, and the wings may be positioned outboard of the glider as shown.

In view of the foregoing disclosure, those who are skilled in this area of technology will recognize that various modifications and additions can be made to the preferred embodiments discussed above without departing from the true scope and spirit of the invention. All such alternative embodiments are intended to be covered by the following claims.

What is claimed is:

1. A cable-drum regulator comprising, in combination:

an elongate guide rail mounted to a support structure;

drive means for moving a windowpane;

a glider assembly attachable to a windowpane wherein the guide rail has left and right receiving flanges and the glider assembly has a main body portion, at least one rail tab unitary with the main body portion and positively snap fitted over one of the receiving flanges, slidably securing the glider assembly to the guide rail, and a reinforcing rib unitary with the main body portion running perpendicular to the guide rail; and a cable assembly comprising a cable connecting the glider assembly to the drive means for longitudinal sliding movement of the glider assembly along the guide rail in response to actuation of the drive means.

2. The cable-drum regulator of claim 1 wherein the glider assembly comprises a glider which is slidably secured by snap fit to the guide rail, and a glider plate for securing a windowpane to the glider.

3. The cable-drum regulator of claim 2 wherein the glider has a second rail tab fitted over another of the receiving flanges of the guide rail.

4. The cable-drum regulator of claim 3 wherein at least one glider rail tab has a beveled surface to guide attachment of the glider over a corresponding receiving flange of the rail.

5. The cable-drum regulator of claim 3 wherein the glider has a pair of right rail tabs and a pair of left rail tabs snap fitted over corresponding receiving flanges of the guide rail, at least one of the pairs of rail tabs having beveled surfaces to guide attachment of the glider over a corresponding receiving flange of the guide rail.

6. The cable-drum regulator of claim 2 wherein the cable assembly has cable end balls at each end of the cable, a first cable end ball attached to the glider at a cable end ball receptacle, and a second cable end ball attached to the drive means.

7. The cable-drum regulator of claim 2 wherein the glider has an inboard side facing the guide rail and an outboard side, and the cable assembly is attached to the outboard side of the glider.

8. The cable-drum regulator of claim 7 wherein the glider has a cable receiving channel in the outboard side, and the glider plate is attached to the outboard side of the glider, sandwiching the cable between the glider and the glider plate.

9. The cable-drum regulator of claim 1 wherein the glider assembly comprises a glider and a one-piece, unitary injection molded plastic glider plate.

10. A cable-drum regulator for controlling a windowpane, comprising, in combination:

drive means for moving a windowpane;

an elongate guide rail mounted to a support structure;

a glider assembly for slidingly interconnecting a windowpane to the guide rail, comprising a glider having an inboard side and an outboard side, slidably secured to the guide rail, and a glider plate for attachment of a windowpane to the glider, wherein at least one of the glider and the glider plate has a flexible finger provided with an insertion digit and the other of the glider and the glider plate has a corresponding opening sized to receive the insertion digit, producing a snap fit engagement between the glider and the glider plate; and a cable assembly connecting the glider assembly to the drive means for longitudinal sliding movement along the guide rail in response to actuation of the drive means.

11. The cable-drum regulator of claim 10 wherein the glider plate has attachment means for securing a windowpane to the glider assembly.

12. The cable-drum regulator of claim 10 wherein the guide rail is attached to the inboard side of the glider and the glider plate is attached to the outboard side of the glider.

13. The cable-drum regulator of claim 10 wherein at least one of the glider and the glider plate has a pair of flexible fingers with insertion digits, and the other of the glider and the glider plate has corresponding openings to receive the insertion digits to produce a snap fit engagement between the glider and the glider plate.

14. The cable-drum regulator of claim 13 wherein one of the flexible fingers is longer than the other.

15. The cable-drum regulator of claim 10 moveable between a full up position and a full down position, wherein the glider further comprises a main body portion and a cushioning downstop unitary with the main body portion for absorbing loading when the cable-drum regulator reaches a full down position.

16. A cable-drum regulator for controlling the movement of a windowpane, comprising, in combination:

drive means for moving a windowpane;

an elongate guide rail mounted to a support structure;

a glider assembly for slidingly interconnecting a windowpane to the guide rail, comprising a glider having an inboard side and an outboard side, slidable on the guide rail, and a glider plate for attaching to a windowpane and to the glider, wherein the glider has upper and lower glider plate retention hooks which are unitary with the glider, and the glider and glider plate are releasably snap fit together to form the glider assembly; and a cable assembly connecting the glider assembly to the drive means for longitudinal sliding movement along the guide rail in response to actuation of the drive means.

17. The cable-drum regulator of claim 16 wherein the glider plate retention hooks restrict motion of the glider plate in the inboard and outboard directions.

18. The cable-drum regulator of claim 16 wherein the glider plate has a center portion and first and second wings extending laterally of the center portion in an offset plane parallel to the center portion, the first and second wings being connected to the center portion by angled connecting segments.

19. The cable-drum regulator of claim 18 wherein the glider plate is insertable laterally into the glider in between upper and lower retention tabs and snap fit to the glider.

20. The cable-drum regulator of claim 18 wherein the center portion fits snugly in a slot between the retention hooks and the first wing is smaller than the center portion.

21. The cable-drum regulator of claim 20 wherein the center portion of the glider plate is smaller than the second wing, the second wing being larger than the slot and forming a positive insertion stop.

22. The cable-drum regulator of claim 16 wherein the glider has at least a pair of flexible fingers with opposed extending digits and the glider plate has openings corresponding to each flexible finger and the extending digits cooperate with the glider plate to secure the glider plate to the glider in all directions.

23. The cable-drum regulator of claim 16 wherein the glider is slidably secured by snap fit to the guide rail.

24. A cable-drum regulator for controlling a windowpane movable from a full up position to a full down position, comprising, in combination:

an elongate vertical guide rail mounted to a support structure;

drive means for moving a windowpane;

a glider assembly for slidingly interconnecting a windowpane to the guide rail, comprising a glider sliding on the rail and a glider plate for securing a windowpane to the glider, wherein the glider comprises a main body and a cushioning downstop unitary with the main body to absorb loading when the cable-drum regulator reaches the full down position; and a cable assembly connecting the glider assembly to the drive means for sliding movement along the glider rail in response to actuation of the drive means.

25. The cable-regulator of claim 24 wherein the glider assembly travels vertically upon actuation of the drive means and the unitary cushioning downstop comprises a pair of open centered w-shaped members extending downwardly from the main body portion of the glider.

26. The cable-drum regulator of claim 24 wherein the glider is slidably secured by snap fit to the guide rail to control the windowpane from the full up position to the full down position, and the glider plate snap fits to the glider.

27. A glider assembly for a cable-drum window regulator regulating motion of a windowpane, moveable from a full-up position to a full-down position, comprising a glider and a glider plate, the glider having rail tabs for securing the glider to a guide rail, flexible fingers with corresponding snap fit insertion digits, and an open-centered unitary cushioning downstop for absorbing loading when the glider assembly reaches the full-down position, and the glider plate having openings to receive the insertion digits allowing the glider plate to be releasably snap fit to the glider, and attachment means for securing the glider plate to a windowpane.

28. A cable-drum regulator for controlling a windowpane movable between a full up position and a full down position, comprising, in combination:

an elongate guide rail mounted to a support structure;

drive means for moving a windowpane;

a glider assembly attachable to a windowpane wherein the guide rail has left and right receiving flanges and the glider assembly has a glider comprising a main body portion, a cushioning downstop unitary with the main body portion for absorbing loading at the full down position, and at least one rail tab unitary with the main body portion and positively snap fitted over one of the receiving flanges slidably securing the glider to the guide rail; and a cable assembly comprising a cable connecting the glider assembly to the drive means for longitudinal sliding movement of the glider assembly along the guide rail in response to actuation of the drive means.

29. A cable-drum regulator comprising, in combination:

an elongate guide rail mounted to a support structure, having left and right receiving flanges;

a windowpane moveable relative the support structure between an open position and a closed position;

drive means for moving the windowpane;

a glider assembly comprising a glider plate having a center portion and first and second wings extending laterally of the center portion in an offset plane parallel to the center portion and connected to the center portion by angled connecting segments, the glider plate being connected to the windowpane via the first and second wings, and a glider attached to the glider plate and having at least one left and one right flexible rail tab, wherein at least one of the rail tabs snap fits over a corresponding receiving flange of the rail, slidably securing the glider to the guide rail; and a cable assembly connecting the glider assembly to the drive means for longitudinal sliding movement of the glider assembly along the guide rail in response to actuation of the drive means.

30. The cable-drum regulator of claim 29 wherein the glider assembly comprises a glider slidably secured by snap fit to the guide rail and a glider plate attached to the windowpane and secured by snap fit to the glider.

31. The cable-drum regulator of claim 30 moveable between a full up position and a full down position, wherein the glider further comprises a main body portion and a cushioning downstop unitary with the main body portion for absorbing loading when the regulator reaches a full down position.

32. A cable-drum regulator for controlling a windowpane, comprising, in combination:

drive means for moving a windowpane;

an elongate guide rail mounted to a support structure;

a glider assembly slidingly interconnecting a windowpane to the guide rail, comprising a glider slidably secured to the guide rail and a glider plate for securing a windowpane to the glider, wherein one of the glider and the glider plate has a flexible portion with a projection forming a snap fit connection between the glider and the glider plate; and a cable assembly connecting the glider to the drive means for longitudinal sliding movement along the guide rail in response to actuation of the drive means.

33. The cable-drum window regulator of claim 32 wherein one of the glider and the glider plate has an insertion digit received in an opening of the other of the glider and the glider plate.

34. A window regulator comprising, in combination:

drive means;

a windowpane having a bottom edge and moveable in response to motion of the drive means between an open position and a closed position;

a bracket secured to the windowpane near the bottom edge; and a moveable member operatively connected to the drive means and moveable with the windowpane, wherein one of the bracket and the moveable member has a flexible finger provided with an insertion digit, and the other of the bracket and the moveable member has a corresponding opening sized to receive the insertion digit, producing a snap fit engagement between the bracket and the moveable member.

* * * * *